US007069674B2

(12) United States Patent
Arii

(10) Patent No.: US 7,069,674 B2
(45) Date of Patent: Jul. 4, 2006

(54) HYDRAULIC CIRCUIT FOR BACKHOE

(75) Inventor: Kazuyoshi Arii, Sakai (JP)

(73) Assignee: Kubota Corporation, Osaka (JP)

( * ) Notice: Subject to any disclaimer, the term of this patent is extended or adjusted under 35 U.S.C. 154(b) by 63 days.

(21) Appl. No.: 10/649,601

(22) Filed: Aug. 26, 2003

(65) Prior Publication Data

US 2004/0123499 A1 Jul. 1, 2004

(30) Foreign Application Priority Data

Dec. 26, 2002 (JP) ..... 2002-378158

(51) Int. Cl.
*E02F 5/02* (2006.01)
*F16D 31/02* (2006.01)

(52) U.S. Cl. ..... 37/348; 60/422; 91/516

(58) Field of Classification Search ..... 37/348, 37/382; 60/420, 421, 422, 494; 91/512, 516, 91/532, 534

See application file for complete search history.

(56) References Cited

U.S. PATENT DOCUMENTS 4,559,965 A * 12/1985 Mickelson ..... 137/115.21
4,663,936 A * 5/1987 Morgan ..... 60/422
5,722,190 A * 3/1998 Arnold ..... 37/348
5,784,945 A * 7/1998 Krone et al. ..... 91/361
6,029,445 A * 2/2000 Lech ..... 60/422
6,173,573 B1 * 1/2001 Kamada ..... 60/422
6,502,499 B1 * 1/2003 Sannomiya et al. ..... 91/436
6,584,770 B1 * 7/2003 Tsuruga et al. ..... 60/422
2003/0089106 A1 5/2003 Ioku et al.

FOREIGN PATENT DOCUMENTS

| | | |
|---|---|---|
| EP | 0 393 342 A2 | 10/1990 |
| EP | 819 795 A1 | 1/1998 |
| JP | 01-223276 | 9/1989 |
| JP | 2001-050209 | 2/2001 |
| JP | 2001-355257 | 12/2001 |
| JP | 2002-206256 A | 7/2002 |

* cited by examiner

*Primary Examiner*—Thomas A. Beach
(74) *Attorney, Agent, or Firm*—The Webb Law Firm

(57) ABSTRACT

A hydraulic circuit for use with a backhoe includes first, second and third pumps; left and right traveling unit valve sections-receiving pressure oil from the first and second pumps independently of each other; a front implement valve section receiving combined pressure oil including oil from respective center oil passages of the left and right traveling unit valve sections; and a swiveling valve section receiving pressure oil from the third pump. A parallel oil passage having a restrictor extends parallel to a center oil passage of the swiveling valve section. The front implement valve section also receives pressure oil from the center oil passage of the swiveling valve section and the parallel oil passage. A load sensing system controls flow amounts of the first and second pumps according to a hydraulic load generated in a front implement operation.

8 Claims, 5 Drawing Sheets

HYDRAULIC CIRCUIT FOR BACKHOE

BACKGROUND OF THE INVENTION

1. Field of the Invention

The present invention relates to a hydraulic circuit for a backhoe including a load sensing system for controlling pump flow amounts according to a sensed load.

2. Description of the Related Art

The above-described type of hydraulic circuit for a backhoe having a load sensing system is known from the Japanese Patent Application "Kokai" No. 2000-206256. According to the backhoe hydraulic circuit disclosed by this reference, when the backhoe is to travel without being accompanied by any implement operation, pressure oils respectively from a first pump and a second pump are supplied independently to a left traveling valve section and a right traveling valve section for driving left and right traveling units. When only a front implement for excavating operation is to be operated with keeping the backhoe still (i.e. under non-traveling condition), the pressure oils from the first and second pumps are combined to be supplied together to a front implement valve section and also flow amounts of these pressure oils from the first and second pumps are controlled according to a hydraulic load during the front implement operation detected by the load sensing system. Further, when the front implement is to be operated while the backhoe keeps traveling, the pressure oils from the first and second pumps are supplied independently to the left and right traveling valve sections and also a pressure oil from a third pump provided for swiveling and dozer operations is also supplied to the front implement valve section.

With the above-described conventional hydraulic circuit, however, since the combined oil from the first and second pumps is supplied to the front implement, the maximum flow amount of each of the first and second pumps is about a half of the maximum flow amount required for a normal front implement operation. For instance, in the case of a backhoe of 5 tons class, the maximum flow amount required for front implement operation is about 130 liters/min. Hence, the maximum flow amount from each of the first and second pumps is about 65 liters/min, so that the combined maximum flow amount from the two pumps exceeds a flow amount (generally, 45 to 50 liters/min) required for traveling of the vehicle of this tonnage class.

Accordingly, in the first-mentioned case when the vehicle is to travel without any implement operation, with supply of the pressure oils to the left and right traveling unit valve sections, a flow-amount control scheme based on power control will cause the first and second pumps to output flow amounts which, when combined, exceeds the required amount for traveling, thus tending to invite overheating and/or excessive rise in temperature of the work oil. Further, in the third-mentioned case when the traveling of the backhoe and the operation of the front implement are to take place at the same time, a selector valve is needed for guiding the pressure oil from the third pump to be supplied together with the other pressure oils to the front implement valve section. The provision of such valve invites cost increase.

In addition, in the case of the above-described backhoe hydraulic circuit, if a swiveling operation of a swivel table and a lift-up operation of a boom for the front implement are effected at one time, a significant inertia of the swivel table at the time of its activation will cause a rise in the start-up pressure, so that the flow amounts of the first and second pumps are reduced by the pump power control scheme, thus resulting in disadvantageous reduction in the rising speed of the boom.

SUMMARY OF THE INVENTION

The present invention addresses to the above-described problem. In the art pertaining to a hydraulic circuit for a backhoe which uses first and second pumps whose flow amounts are controlled (load sensing controlled) and a third pump for swiveling, and in which hydraulic drive of a front implement is effected under the control of a load sensing system, a primary object of the invention is to provide a hydraulic circuit which allows reduction in the size of the first and second pumps and renders the supply amount of the pressure oil to the traveling unit valve sections appropriate and which also restricts undesired reduction in the rising speed of the boom at the time of start-up of swiveling operation when the swiveling operation of the swivel table and the lift-up operation of the front implement boom are effected at the same time, thereby to allow the operations to take place efficiently with improved maneuverability For accomplishing the above-noted object, according to the present invention, there is provided a hydraulic circuit for a backhoe, including:

first, second and third pumps driven by an engine;

left and right traveling unit valve sections configured to receive pressure oil from the first pump and the second pump independently of each other;

a front implement valve section;

a swiveling valve section configured to receive pressure oil from the third pump; and a load sensing system for controlling flow amounts of the first and second pumps according to a hydraulic load generated in a front implement operation;

wherein said front implement valve section is configured to receive combined pressure oil including oil discharged from a center oil passage of said left traveling unit valve section and oil discharged from a center oil passage of the right traveling unit valve section; and wherein said front implement valve section is configured to receive also pressure oil from a parallel oil passage having a restrictor and disposed parallel to a center oil passage of said swiveling valve section and oil from a center oil passage of the swiveling valve section.

With the above-described construction, when the front implement valve section is to be operated, the combined pressure oils from the first through third pumps are supplied to the section. Therefore, the maximum flow amount of these combined pressure oils may be set to a maximum flow amount needed for a front implement operation. For instance, if the maximum flow amount needed for the front implement operation is 130 liters/min, with setting of the flow amount of the third pump to 30 liters/min, the maximum flow amounts of the first and second pumps may be 50 liters/min, respectively.

Also, if a swiveling operation is to be effected with keeping the backhoe stationary, due to the load generated in association with start of the swiveling operation, there occurs rise in the pressure in the swiveling valve section, so that a portion of the pressure oil from the third pump is caused to flow via the parallel oil passage to the pressure oil supply passage of the front implement valve section. In this, in the case of a "swiveling-alone mode" of operation not using the front implement valve section, the pressure oil supply passage will be closed, so that the entire pressure oil from the third pump will be supplied to the swiveling valve section.

Whereas, if the swiveling operation is to take place with simultaneous operation of the front implement, in response to the rise in the oil pressure in the swiveling valve section due to the load associated with start of the swiveling operation, a portion of the pressure oil from the third pump is caused to flow via the parallel oil passage to the pressure oil supply passage of the front implement valve section also, resulting in acceleration in the operation of the front implement, e.g. the lift-up operation of its boom.

Therefore, according to the present invention, the first pump and the second pump may be formed small and also the supply amount of the pressure oil to the traveling unit valve sections may be rendered appropriate. Moreover, since the pressure oil from the third pump is constantly and unilaterally supplied to the front implement valve section, unlike the conventional construction, there is no need for providing the pilot type selector valve for combining the oil for the third pump. Hence, the construction of the invention can contribute to simplification of the entire hydraulic circuit and its cost reduction.

In addition, when the driving of the front implement and the swiveling operation are to be effected at one time, it is possible to restrict disadvantageous deceleration in the movement of the front implement such as the lift-up movement of its boom. So that, with the improved maneuverability, the two operations can be effected in an efficient manner.

According to one preferred embodiment of the invention, in order to construct a load sensing system best suited for the backhoe, there is employed an outer-orifice type load sensing system as the load sensing system. And, this load sensing system comprises pressure compensation valves connected to the downstream of spools of respective control valves included in the front implement valve section and an unload valve connected to the upstream of the pressure oil supply passage of the front implement valve section.

Further and other features and advantages of the invention will become apparent upon reading the following detailed disclosure of the invention with reference to the accompanying drawings.

DESCRIPTION OF THE PREFERRED EMBODIMENTS

Figure 1:
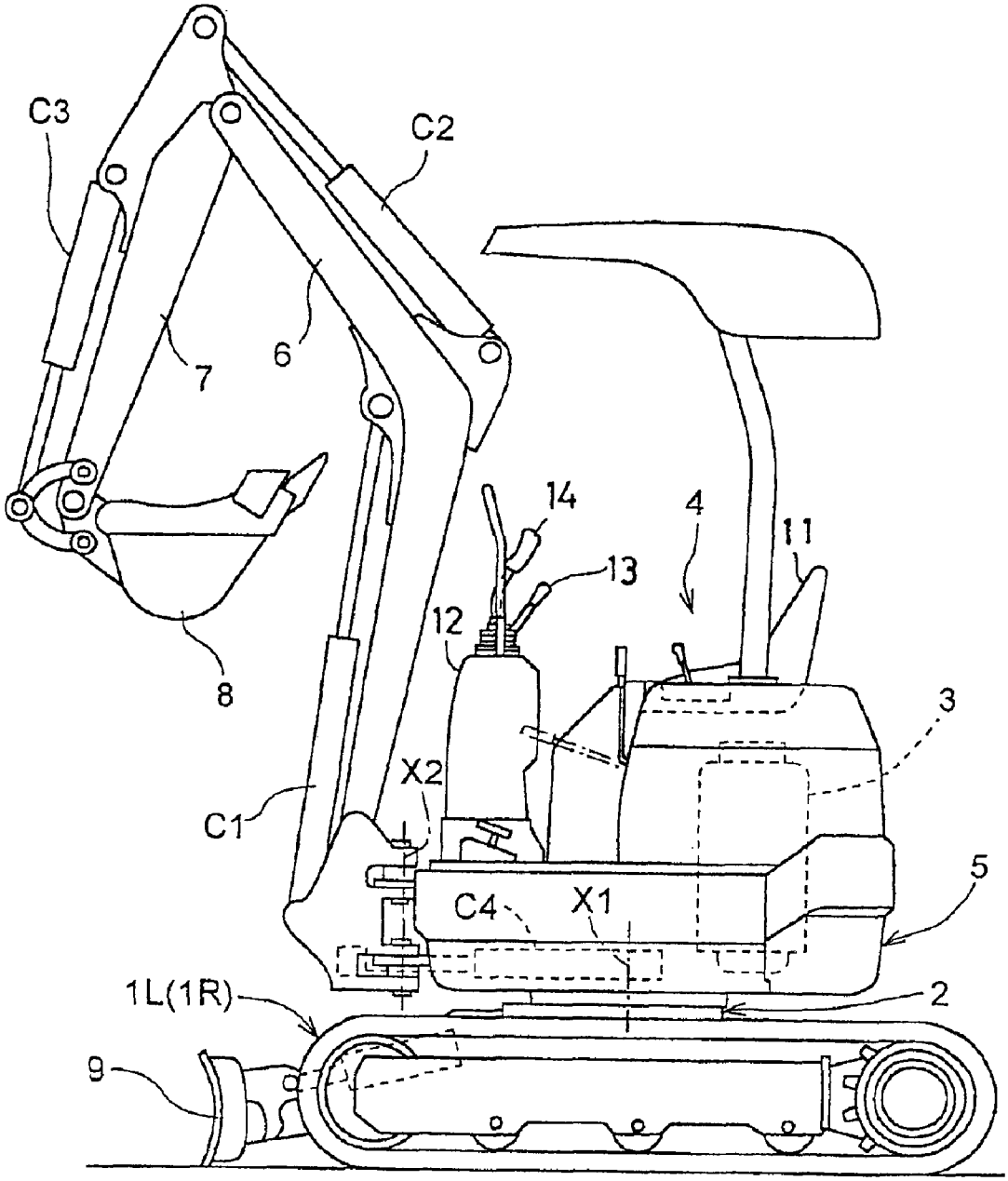
FIG. 1 is an overall side view of a backhoe implementing a hydraulic circuit according to the present invention.

FIG. 1 is an overall side view of a backhoe implementing a hydraulic circuit according to the present invention. In this backhoe, on top of a traveling vehicle chassis 2 mounting a pair of left and right crawler type traveling units 1L, 1R, a swiveling table 5 mounting an engine 3 and a driver's section 4 is disposed to be capable of total-angle swiveling movement about a vertical axis X1. To the front of this swivel table 5, there is mounted a front implement 9 including a boom 6, an arm 7 and a bucket 8 interconnected in series. Further, an excavator plate 10 for dozer operation is attached to the front of the traveling vehicle chassis 2.

The left and right traveling units 1L, 1R are driven forwardly and reversely by traveling hydraulic motors ML, MR, respectively. The swivel table 5 is driven to be swiveled to the left or the right by a swiveling hydraulic motor MT. The boom 6, the arm 7 and the bucket 8 together constituting the front implement 9 are driven respectively by a boom cylinder C1, an arm cylinder C2 and a bucket cylinder C3. Further, a swing cylinder C4 is provided for driving the entire front implement 9 to be swung (pivoted) to the left or the right about a vertical axis X2. A dozer cylinder C5 is provided for vertically driving the excavator plate 10.

Figure 2:
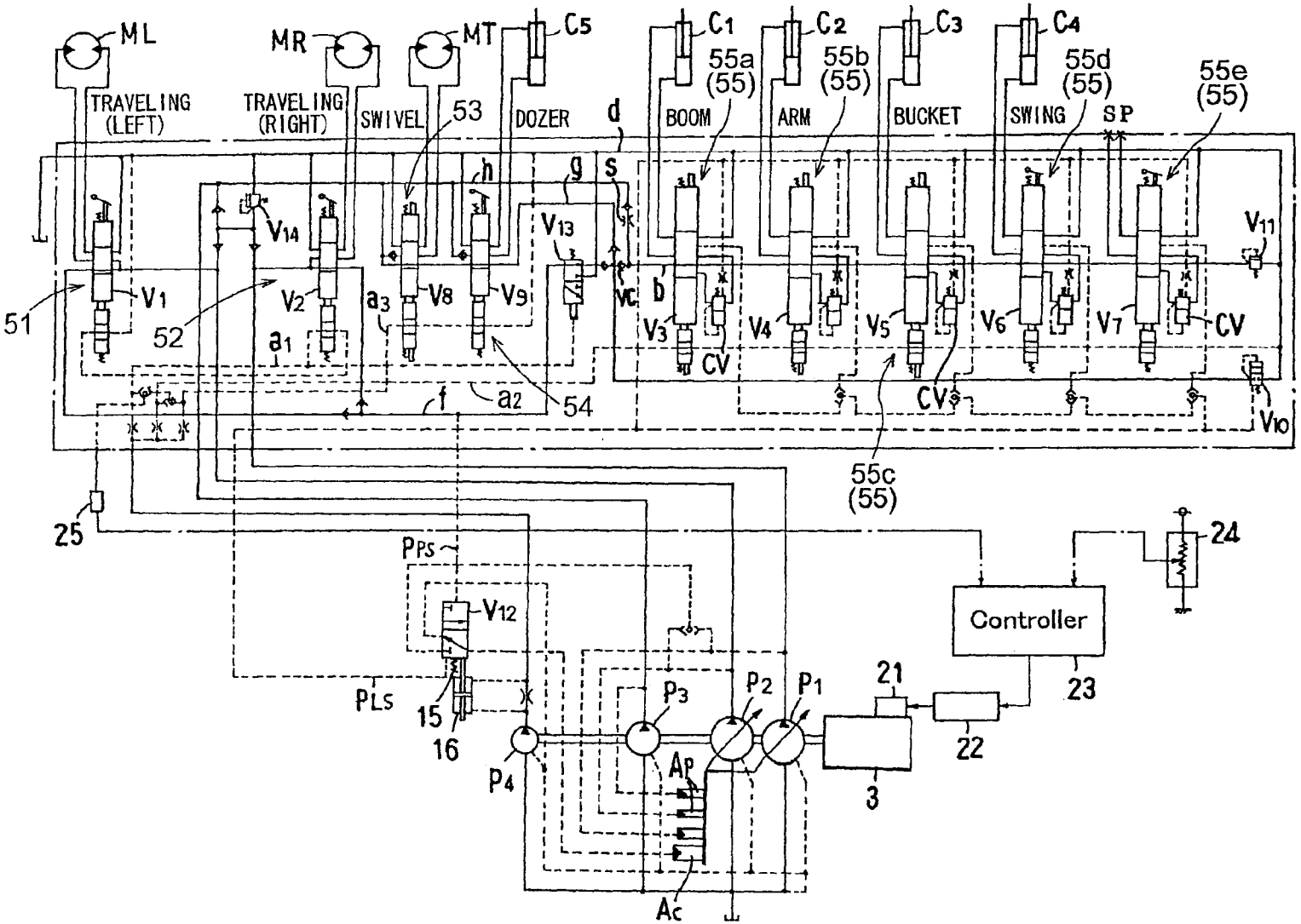
FIG. 2 is an overall view of the hydraulic circuit according to the invention.

FIG. 2 shows a hydraulic circuit for driving the respective hydraulic actuators described above. In the figure, V1 denotes a control valve for the left traveling unit, V2 denotes a control valve for the right traveling unit, V3 denotes a control valve for the boom, V4 denotes a control valve for the arm, V5 denotes a control valve for the bucket, V6 denotes a control valve for the swing, V7 denotes a control valve for a service port, V8 denotes a control valve for the swiveling, and V9 denotes a control valve for the dozer, respectively. The control valves V1, V2 for the left and right traveling are of a manual operation type whose spools are directly operated by a left/right traveling lever 13 provided in a control column 12 disposed forwardly of an operator's seat 11. The control valves V6, V7 and V9 for the swing, the service port and the dozer are of a manual operation type whose spools are directly operated by a lever or pedal operation. Further, the control valves, V3, V4, V5 and V8 for the boom, the arm, the bucket and the swiveling are of a hydraulic pilot operation type. Each of these hydraulic pilot operation type control valves can be operated to an opening degree corresponding to a lever operation amount by a pilot pressure supplied from a corresponding pilot valve (not shown) operable by a pair of left and right cross-operable implement operation levers 14 provided on the control column 12.

As the pressure oil source for this hydraulic circuit, there are provided first pump P1, second pump P2, third pump P3 driven by the engine 3 and a pilot pump P4. The first pump P1 and the second pump P2 are used mainly for driving the traveling units and the front implement. These pumps P1, P2 comprise variable displacement axial plunger pumps whose discharge amount is variable by changing inclination of a swash plate and whose flow amount is controlled by a load sensing system to be described later. The third pump P3 is used mainly for the swiveling operation and the dozer operation. This pump P3 is a fixed displacement gear pump. Further, the pilot pump P4 is used for supplying the pilot pressure and this pump P4 is also a fixed displacement gear pump operable to supply the source pilot pressure to an unillustrated pilot valve and supplying a pilot pressure also to three pilot oil passages a1, a2, a3 for pilot operation detection.

This hydraulic circuit can be sectioned into a left traveling valve section 51, a right traveling valve section 52, a swiveling valve section 53, a dozer valve section 54, and a front implement valve section 55. The front implement valve section 55 consists of a boom subsection 55*a*, an arm subsection 55*b*, a bucket subsection 55*c*, a swing subsection 55*d*, and a service port subsection 55*e*.

The load sensing system is configured to control pump discharge amounts according to a work load for causing the respective pumps to discharge an oil pressure force required for the load, thereby to achieve power saving and improvement of maneuverability. Specifically, this load sensing system comprises an outer-orifice type load sensing system including pressure compensation valves CV connected to the downstream of spools of respective subsection valves V3 through V7 of the boom subsection 55*a*, the arm subsection 55*b*, the bucket subsection 55*c*, the swing subsection 55*d* and the service port subsection 55*e*.

The load sensing system further includes an unload valve V10 connected to the upstream of a pressure oil supply passage (b) of the front implement valve section 55 and a system relief valve V1 connected to the downstream of the pressure oil supply passage (b).

A flow amount compensation valve V12 is provided for controlling the flow mounts of the first pump P1 and the second pump P2. Further, a flow amount compensation piston Ac and a power control piston Ap are provided for adjusting inclination of swash plates of the first pump P1 and the second pump P2. A maximum negative pressure on load detecting lines of the respective subsections of the front implement valve section 55 is transmitted as a control signal pressure PLS to the flow amount compensation valve V12, so that the discharge amounts from the first pump P1 and the second pump P2 are controlled in such a manner as to maintain a difference between the signal pressure PLS and a discharge pressure PPS of the first pump P1 and the second pump P2 at the control differential pressure applied to the flow amount compensation valve V12. Incidentally, as will be described later, the discharge pressure of the first pump P1 and the second pump P2 is detected as a pressure of an oil passage (f) combining center drain oil passages e1, e2 of the left and right traveling unit valve sections 51, 52.

In the above, the control differential pressure applied to the flow amount compensation valve V12 is provided by a spring 15 and a differential pressure piston 16, as shown in FIG. 2. In operation, when the discharge amount of the pilot pump P4 is increased in response to increase in the rotational speed of the engine 3, the differential pressure piston 16 provides a greater component in the control differential pressure, so that the discharge flow amounts of the first pump P1 and the second pump P2 will be increased correspondingly. Conversely, when the discharge amount of the pilot pump P4 is decreased in response to decrease in the rotational speed of the engine 3, the differential pressure piston 16 provides a smaller component in the control differential pressure, so that the discharge flow amounts of the first pump P1 and the second pump P2 will be decreased correspondingly.

Further, while the respective subsections of the front implement valve section 55 partly constitute the load sensing system, the respective valve sections for the traveling units, the swiveling and the dozer comprise open circuits. More particularly, the center oil passages e1, e2 of the left and right traveling valve sections 51, 52 are converged to the oil passage (f). And, this oil passage (f) is connected, via a pilot type passage selector valve V13, to the pressure oil supply passage (b) of the front implement valve section 55. Further, a center oil passage (g) of the swiveling valve section 53 and the dozer valve section 54 is connected to the pressure oil supply passage (b) of the front implement valve section and a parallel oil passage (h) branched from the discharge oil passage of the third pump and disposed in parallel to the swiveling valve section 53 and the dozer valve section 54 is connected via a constrictor (s) to the pressure oil supply passage (b) of the front implement valve section 55.

Also, the unload valve V10 of the load sensing system is connected to an upstream portion (j) more upstream than a connected portion (i) between the parallel passage (h) and the pressure oil supply passage (b). And, between these connected portions (i), (j), there is interposed a back-flow preventing check valve Vc.

The maximum pressures of the first pump P1, the second pump P2 and the third pump P3 are controlled by the common relief valve V14.

With switchover of the passage selector valve 13, there are realized various pressure oil supplying conditions described next.

Stationary Front Implement Work

Figure 3:
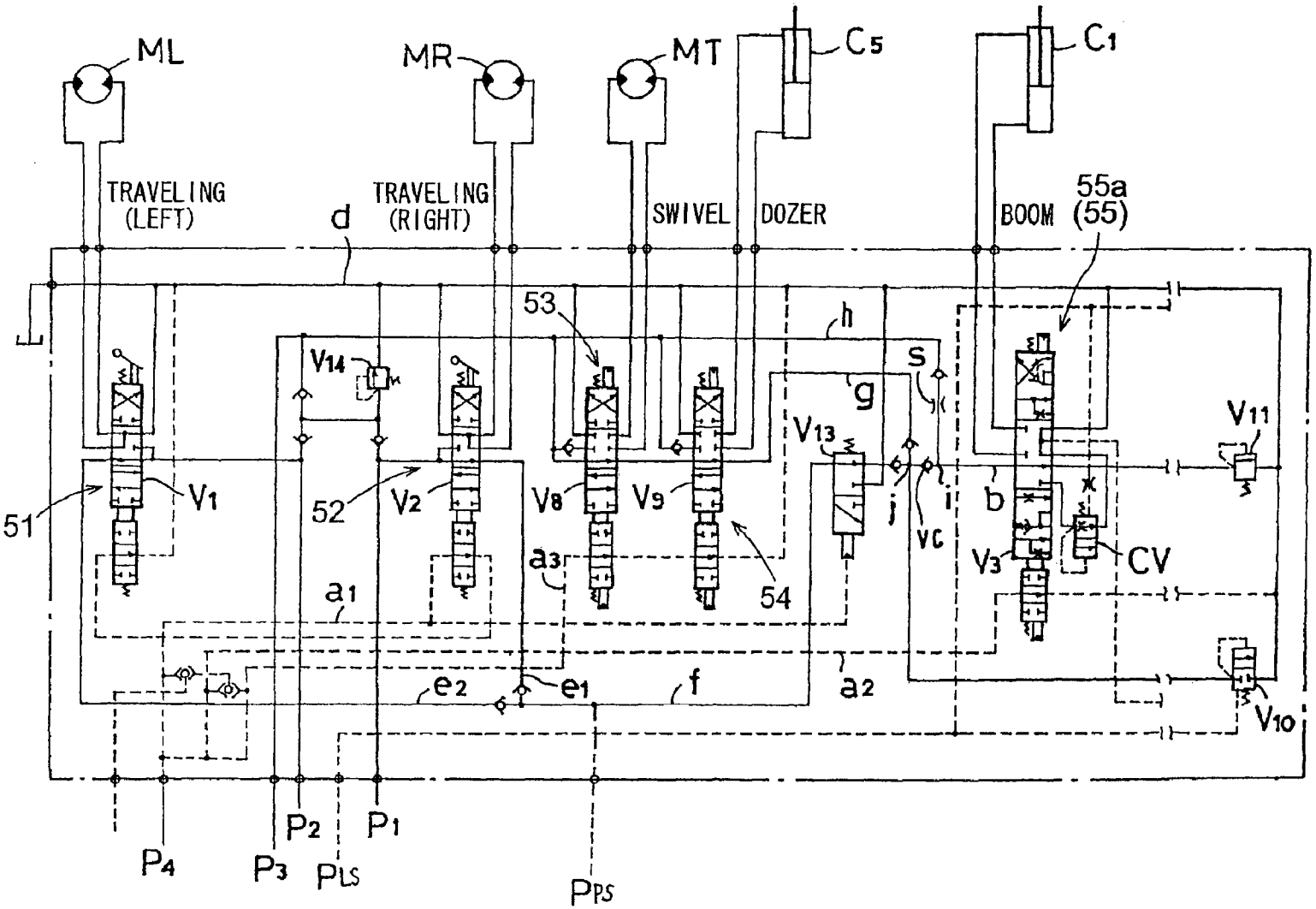
FIG. 3 shows principal portions of the hydraulic circuit according to the invention.
Figure 4:
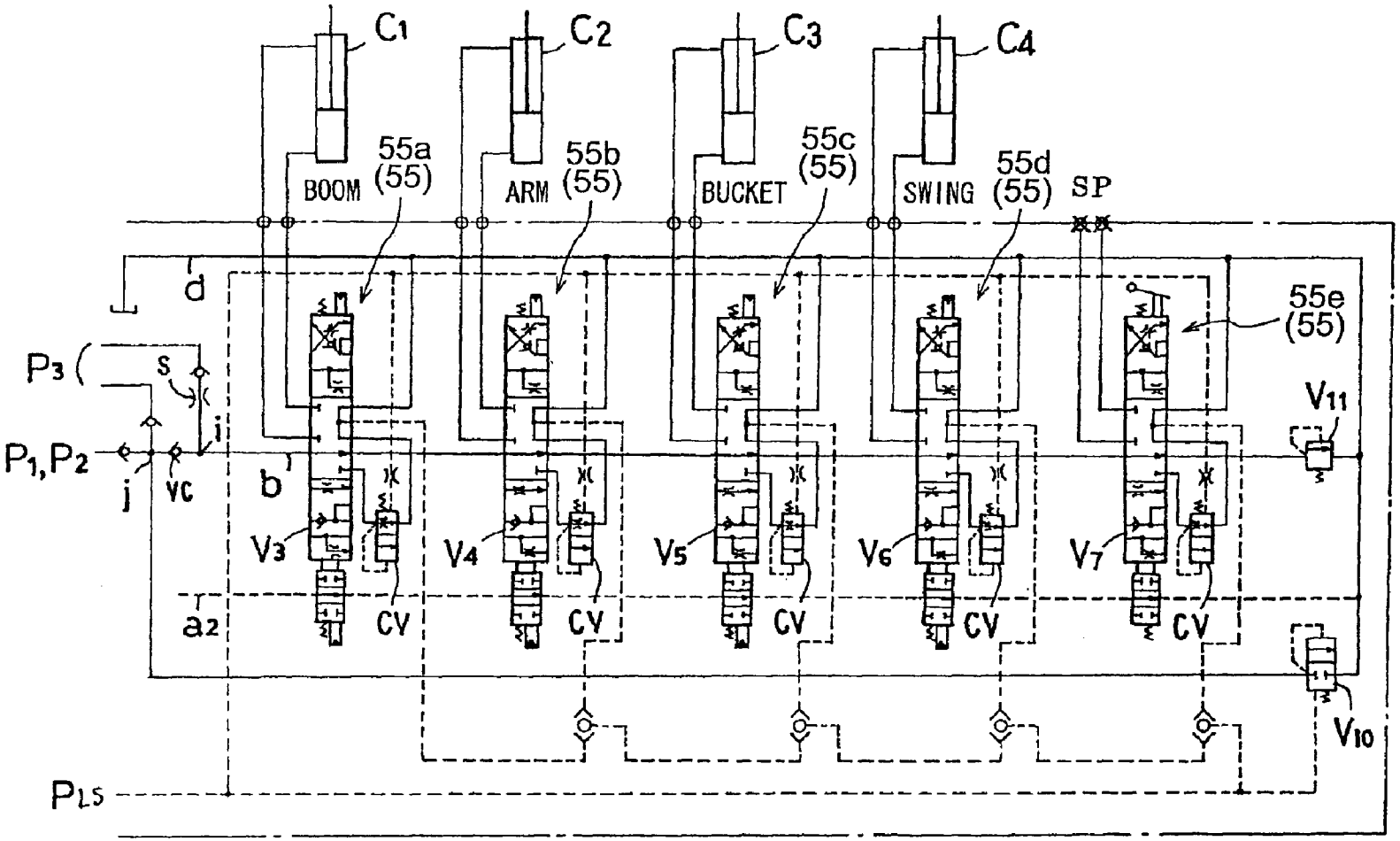
FIG. 4 is a diagram of a portion of the hydraulic circuit of the invention which portion forms a load sensing system.
Figure 5:
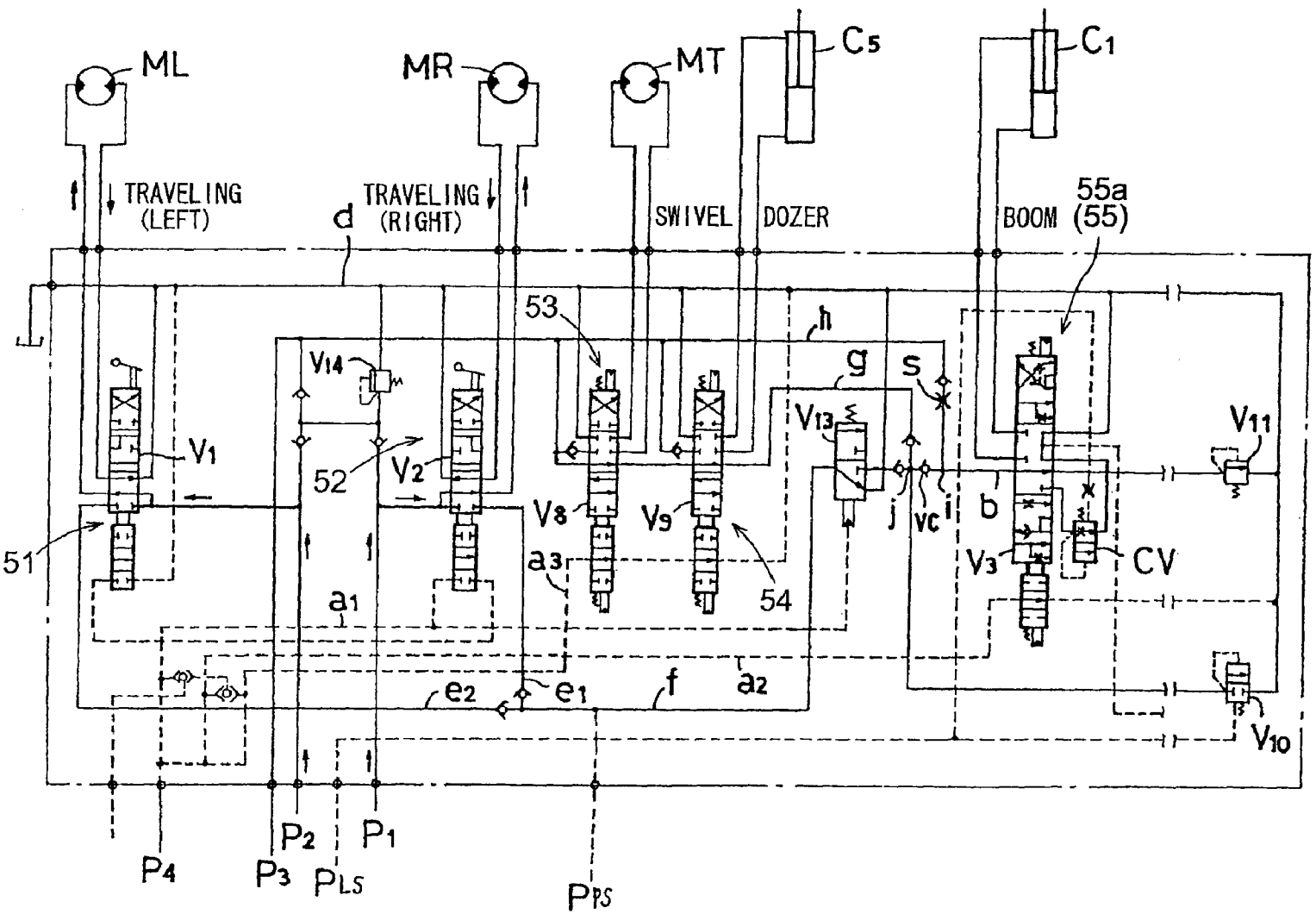
FIG. 5 is a diagram of the hydraulic circuit under a condition involving only traveling of the backhoe.

When the backhoe is stationary, i.e. not traveling, as shown in FIG. 3, there is developed no pressure in the pilot oil passage a1, so that the passage selector valve V13 is under oil supplying condition. Accordingly, the center discharged oil from the first pump P1 and the second pump P2 is supplied via the oil passage (f) and the passage selector valve V13 to the pressure oil supply passage (b) of the front implement valve section 55 which constitutes a part of the load sensing system. Further, the pressure oil from the third pump P3 is also supplied to the pressure oil supply passage (b) of the front implement valve section 55 via the center oil passage (g) of the swiveling valve section 53 and the dozer valve section 54. That is to say, when the backhoe is not traveling, the entire oil from the first through third pumps P1, P2, P3 is supplied to the pressure oil supply passage (b) of the front implement valve section 55.

Therefore, for instance, if the maximum flow amount needed for front implement operation is 130 liters/min, with setting of the flow amount of the third pump to 30 liters/min, the total oil amount of 100 liters/min is required from the first pump P1 and the second pump P2. Then, the maximum flow amounts of the first and second pumps may be 50 liters/min, respectively.

And, when the front implement 9 is operated, the load sensing system controls the flow amounts of the first pump P1 and the second pump P2, so that the pressure oil is supplied by an amount corresponding to the load.

Stationary Swiveling Operation

If a swiveling operation is to be effected with keeping the backhoe stationary, due to the load generated in association with start of the swiveling operation, there occurs rise in the pressure in the swiveling valve section 53, so that a portion of the pressure oil from the third pump P3 is caused to flow via the parallel oil passage (h) to the pressure oil supply passage (b) of the front implement valve section 55. In this, in the case of a "swiveling-alone mode" of operation not using the front implement valve section 55, the pressure oil supply passage (b) will be closed, so that the entire pressure oil from the third pump P3 will be supplied to the swiveling valve section 53.

Whereas, if the swiveling operation is to take place with simultaneous operation of the front implement 9, in response to rise in the oil pressure in the swiveling valve section 53 due to the load associated with start of the swiveling operation, a portion of the pressure oil from the third pump P3 is caused to flow via the parallel oil passage (h) to the pressure oil supply passage (b) of the front implement valve section 55 also, resulting in acceleration in the operation of the front implement 9, e.g. the lift-up operation of its boom.

Traveling

If at least one of the left and right traveling unit valve sections 51, 52 is operated while the front implement valve section 55 is under its open condition, a pressure is developed in the pilot oil passage a1, so that the passage selector valve V13 is switched over to break communication between the oil passage (f) and the pressure oil supply passage (b) and also to establish communication between the oil passage (f) and the drain passage (d), whereby the pressure oils from the first pump P1 and the second pump P2 are supplied independently only to the right traveling hydraulic motor MR and the left traveling hydraulic motor ML.

In the course of the above, since the oil pressure of the oil passage (f) located upstream of the passage selector valve V13 is detected as the pump discharge pressure PPS, with the switchover of the passage selector valve V13 to the oil draining condition, the pressure of the oil passage (f), that is, the pump discharge pressure PPS in the load sensing system becomes zero, so that the swash plate inclination will be controlled so as to cause the first pump P1 and the second pump P2 to discharge the maximum flow amount respectively.

Traveling Front Implement Operation

If the front implement 9 is operated while the backhoe is traveling, a pressure is developed in the pilot oil passage a1, so that the passage selector valve V13 is switched over to the oil draining condition, whereby the oil supply from the left and right traveling unit valve sections 51, 52 to the front implement valve section 55 is prevented and the pressure oil from the third pump P3 alone is supplied to the front implement valve section 55.

Incidentally, in this embodiment, there is provided an automatic idling control system is provided for automatically operating an accelerator for the engine 3. More particularly, as shown in FIG. 1, a governor 21 of the engine 3 is adapted to be operable by an electric actuator 22. And, to a controller 23 for controlling the operation of this electric actuator 22, there are connected an accelerator setting device 24 provided at the driver's section 4 and using a potentiometer and a pressure switch 25 adapted for detecting pressure rise in any one of the pilot oil passages a1, a2, a3. In operation, by the operator's desired setting of the accelerator setting device 24, an accelerator may be set for the work. And, when all of the control valves V1 through V9 are under the neutral condition, all of the pilot oil passages a1, a2, a3 are drained, so that the pressure switch 25 is not activated in response to pressure. And, in this condition, the governor 21 will be automatically set for deceleration to the idling position by the electric actuator 22. On the other hand, when any one of the control valves V1 through V9 is operated, a pressure is developed in one of the pilot oil passages a1, a2, a3, and this pressure is detected by the pressure switch 25. In response to this pressure-sensitive activation of the pressure switch 25, the governor 21 will be automatically set for acceleration to an accelerator position set by the accelerator setting device 24. That is to say, during a non-work condition when the front implement is not operated or the backhoe is not traveling, the speed of the engine 3 is automatically reduced to the predetermined idling speed so as to reduce noise and fuel consumption. Whereas, when either an implement work or traveling of the backhoe is effected, the speed of the engine 3 is automatically raised to a set speed so as to supply the required hydraulic power for allowing the desired implement work or the backhoe traveling to proceed efficiently.

What is claimed is:

1. A hydraulic circuit for a backhoe, comprising:

first, second and third pumps driven by an engine;

left and right traveling unit valve sections configured to receive pressure oil from the first pump and the second pump independently of each other;

a front implement valve section configured to receive combined pressure oil including oil discharged from a center oil passage of said left traveling unit valve section and oil discharged from a center oil passage of the right traveling unit valve section;

a swiveling valve section configured to receive pressure oil from the third pump; and a parallel oil passage having a restrictor and disposed parallel to a center oil passage of said swiveling valve section;

wherein said front implement valve section is configured to receive also pressure oil from the center oil passage of the swiveling valve section and the parallel oil passage; and there is provided a load sensing system for controlling flow amounts of the first and second pumps according to a hydraulic load generated in a front implement operation.

2. The hydraulic circuit for a backhoe according to claim 1, wherein said load sensing system comprises an outer-orifice type load sensing system.

3. The hydraulic circuit for a backhoe according to claim 2, wherein said load sensing system comprises pressure compensation valves connected to the downstream of spools of respective control valves included in the front implement valve section and an unload valve connected to the upstream of the pressure oil supply passage of the front implement valve section.

4. The hydraulic circuit for a backhoe according to claim 3, wherein a system relief valve is connected to the downstream of said pressure oil supply passage.

5. A hydraulic circuit for a backhoe, comprising:

first, second and third pumps driven by an engine;

left and right traveling unit valve sections configured to receive pressure oil from the first pump and the second pump independently of each other;

a front implement valve section configured to receive combined pressure oil of said left and right traveling unit valve sections;

a swiveling valve section configured to receive pressure oil from the third pump; and a parallel oil passage having a restrictor and disposed parallel to a center oil passage of said swiveling valve section;

wherein said front implement valve section is configured to receive also pressure oil from the center oil passage of the swiveling valve section and the parallel oil passage; and there is provided a load sensing system for controlling flow amounts of the first and second pumps according to a hydraulic load generated in a front implement operation.

6. The hydraulic circuit for a backhoe according to claim 5, wherein said load sensing system comprises an outer-orifice type load sensing system.

7. The hydraulic circuit for a backhoe according to claim 6, wherein said load sensing system comprises pressure compensation valves connected to the downstream of spools of respective control valves included in the front implement valve section and an unload valve connected to the upstream of the pressure oil supply passage of the front implement valve section.

8. The hydraulic circuit for a backhoe according to claim 7, wherein a system relief valve is connected to the downstream of said pressure oil supply passage.

* * * * *

UNITED STATES PATENT AND TRADEMARK OFFICE

CERTIFICATE OF CORRECTION

PATENT NO. : 7,069,674 B2
APPLICATION NO. : 10/649601
DATED : July 4, 2006
INVENTOR(S) : Arii It is certified that error appears in the above-identified patent and that said Letters Patent is hereby corrected as shown below:

On the title page Item (56) References Cited,

FOREIGN PATENT DOCUMENTS, add

JP 08-199632 08/1996

Signed and Sealed this

Twelfth Day of December, 2006

JON W. DUDAS
*Director of the United States Patent and Trademark Office*